US009822564B2

(12) United States Patent
Dreisewerd

(10) Patent No.: US 9,822,564 B2
(45) Date of Patent: Nov. 21, 2017

(54) RECESSED DOOR HINGE

(71) Applicant: SIMONSWERK GmbH, Rheda-Wiedenbrueck (DE)

(72) Inventor: Nikolaus Dreisewerd, Rietberg (DE)

(73) Assignee: SIMONSWERK GMBH, Rheda-Wiedenbrueck (DE)

( * ) Notice: Subject to any disclaimer, the term of this patent is extended or adjusted under 35 U.S.C. 154(b) by 0 days.

(21) Appl. No.: 15/223,162

(22) Filed: Jul. 29, 2016

(65) Prior Publication Data

US 2017/0030120 A1 Feb. 2, 2017

(30) Foreign Application Priority Data

Jul. 31, 2015 (DE) ..... 10 2015 112 647

(51) Int. Cl.
*E05D 7/04* (2006.01)
*E05D 3/18* (2006.01)
(Continued)

(52) U.S. Cl.
CPC ..... *E05D 7/04* (2013.01); *E05D 3/06* (2013.01); *E05D 3/186* (2013.01); *E05D 5/02* (2013.01);
(Continued)

(58) Field of Classification Search
CPC .... E05D 3/06; E05D 3/12; E05D 3/14; E05D 3/142; E05D 3/16; E05D 3/125; E05D 3/127; E05D 3/185; E05D 7/04; E05D 7/0423; E05D 7/0415; E05D 7/043; E05D 7/0027; E05D 7/0045; E05D 5/02; E05D 5/062; E05D 2007/0438; E05D 2007/0446; E05D 2007/0453; E05D 2007/0461; E05D 2007/0469; E05D 2007/0476; E05D 2007/0484; E05D 2007/0492; E05Y 2600/41; E05Y 2600/634; E05Y 2600/412;
(Continued)

(56) References Cited

U.S. PATENT DOCUMENTS 6,829,808 B2 * 12/2004 Neukotter ..... E05D 3/186 16/366
7,861,378 B2 1/2011 Neukoetter
(Continued)

FOREIGN PATENT DOCUMENTS

CN 202039705 U * 11/2011
DE 10164979 B 5/2003
(Continued)

*Primary Examiner* — Chuck Mah
(74) *Attorney, Agent, or Firm* — Andrew Wilford

(57) ABSTRACT

A hinge for recessed installation between a door frame and a door panel that has first and second housings adapted for recessing in the door frame and an edge of the door panel, a pair of links having ends pivoted in the housings and pivoted together about a vertical axis extending in a vertical direction perpendicular to mutually perpendicular first and second horizontal directions, and two supports in the second housing in which the respective ends of the links are pivoted. A vertical connector body to which the supports are fixed is limitedly vertically movable in the first housing along with the supports and links. Respective pairs of guide faces on the connector body spaced apart in the vertical direction flank each of the supports.

9 Claims, 4 Drawing Sheets

(51) Int. Cl.
*E05D 3/06* (2006.01)
*E05D 5/02* (2006.01)
*E05D 7/00* (2006.01)

(52) U.S. Cl.
CPC ..... *E05D 7/0027* (2013.01); *E05D 7/0045* (2013.01); *E05D 7/0415* (2013.01); *E05D 7/0423* (2013.01); *E05D 2007/0469* (2013.01); *E05D 2007/0476* (2013.01); *E05D 2007/0484* (2013.01); *E05D 2007/0492* (2013.01); *E05Y 2201/638* (2013.01); *E05Y 2600/41* (2013.01); *E05Y 2600/634* (2013.01); *E05Y 2900/132* (2013.01)

(58) Field of Classification Search
CPC ..... E05Y 2600/45; E05Y 2600/452; E05Y 2600/46; E05Y 2900/132; E05Y 2900/20; E05Y 2900/50; E05Y 2900/531; E05Y 2900/546; E05Y 2201/638
See application file for complete search history.

(56) References Cited

U.S. PATENT DOCUMENTS

| | | | | |
|---|---|---|---|---|
| 8,196,265 | B2 | 6/2012 | Neukoetter | |
| 8,434,197 | B2 * | 5/2013 | Oshima | E05D 3/186 16/241 |
| 8,621,717 | B2 | 1/2014 | Liermann | |
| 8,683,651 | B2 | 4/2014 | Liermann | |
| 8,863,361 | B2 | 10/2014 | Neukoetter | |
| 2010/0115729 | A1 | 5/2010 | Neukoetter | |

FOREIGN PATENT DOCUMENTS

| | | | | |
|---|---|---|---|---|
| DE | EP 1754848 | A2 * | 2/2007 | E05D 3/186 |
| DE | 102011002216 | B3 * | 12/2011 | E05D 7/0423 |
| IT | EP 2450512 | A1 * | 5/2012 | E05D 3/186 |

* cited by examiner

RECESSED DOOR HINGE

FIELD OF THE INVENTION

The present invention relates to a recessed door hinge. More particularly this invention concerns such a hinge for installation between an edge of a door panel and a door frame.

BACKGROUND OF THE INVENTION

A typical such door hinge has a first housing and a second housing that can be inserted into respective recesses in the door frame and a narrow edge of the door panel and a link assembly that connects the housings and has a least two links connected to one another pivotably at a vertical hinge pin. The link assembly is rotatable and usually axially or longitudinally movably on the first housing in two separate inserts that are spaced from one another. These inserts are fastened jointly to a connector body extending over the height of the link assembly and the connector body with the inserts carried thereon and the link assembly are all adjustable in the vertical direction relative to the first housing.

The alignment of the vertical axis relates to the conventional installation situation of the door hinge.

Different configurations are known for concealed door hinges. By comparison with door hinges with an exposed hinge knuckle, the advantage is produced that doors can be integrated optimally in planar wall surfaces without being visible when the door is closed. As a result, the advantage is produced that when the door is closed the hinges are protected from environmental influences, damage or tampering. Furthermore, due to the form of the link assembly specially adapted pivoting sequences can be provided, in order also for example to be able to open doors with an offset. Finally, concealed door hinges frequently have an opening angle of 180°.

In order that the door panel can still be adjusted in the door frame even after installation, door hinges frequently have adjusting mechanisms making possible adjustment in three directions. The height of the door panel in the door frame can be adjusted by a height adjustment in the vertical direction. With a lateral adjustment in the horizontal direction parallel to the faces of the door panel, the door panel can be moved laterally with respect to its closed position inside the door frame. Finally, an adjustment of the door panel in the direction its thickness is possible, which is designated as a compression adjustment. This designation derives from the fact that an adjustment in the direction of the thickness as a rule determines the force with which a seal between the door panel and the door frame is compressed.

Various approaches are known for making the height adjustment.

According to U.S. Pat. No. 7,861,378, a height adjustment in the vertical direction can be achieved in that the entire first housing is carried by longitudinal slots on the door frame or on the door panel. However, this then produces the disadvantage that the milled groove must have a certain oversize, and the height adjustment is also difficult.

According to U.S. Pat. Nos. 8,621,717, 8,683,651, 6,829,808 and DE 101 64 979, the first housing is fixed on the door panel or on the door frame, and the inserts are then movable with the link assembly relative to the first housing. In particular, an adjusting mechanism can be provided that exerts force in the vertical direction onto the lower insert, so that the link assembly is raised or lowered with the two inserts in the first housing. However, this then results in the disadvantage that during adjustment the acting forces are transmitted via the link assembly and the mounting thereof to the inserts, and also it is not possible to rule out considerable play.

According to U.S. Pat. No. 8,863,361, US 2010/0115729, DE 10 2009 038 955 and U.S. Pat. No. 8,196,265, starting from the known basic form of a recessed door hinge the inserts are rigidly retained on a main body, and this main body is adjustable in the vertical direction relative to separate end pieces. This then produces the advantage that the main body and inserts form a rigid unit that can withstand vertical loads. However, even with such a multipart structure, considerable play can be produced that, in the event of high loading of the door hinge, can lead to misalignment or wear.

A door hinge with the features described in the introduction is known in the art and marketed by Koblenz SPA under the product designation Kubica® K2400. The inserts that support the link assembly are fastened to a common connector body extending over the height of the link assembly and the connector body with the inserts and the link assembly is adjustable as a unit in the vertical direction relative to the first housing. The stability of the door hinge requires further improvement, especially when carrying a substantial weight.

OBJECTS OF THE INVENTION

It is therefore an object of the present invention to provide an improved recessable door hinge.

Another object is the provision of such an improved recessable door hinge that overcomes the above-given disadvantages, in particular that has increased stability and reduced wear.

SUMMARY OF THE INVENTION

These objects are attained by a hinge for recessed installation between a door frame and a door panel that has first and second housings adapted for recessing in the door frame and an edge of the door panel, a pair of links having ends pivoted in the housings and pivoted together about a vertical axis extending in a vertical direction perpendicular to mutually perpendicular first and second horizontal directions, and two supports in the second housing in which the respective ends of the links are pivoted. A vertical connector body to which the supports are fixed is limitedly vertically movable in the first housing along with the supports and links. Respective pairs of guide faces on the connector body spaced apart in the vertical direction flank each of the supports.

Thus, the inserts are each retained in positive engagement on the common connector body in a vertical direction between a substantially horizontal guide face and a guide face of the connector body. Due to the additional fixing of the inserts on the connector body in positive engagement, any play or movability of the inserts relative to the connector body can be significantly reduced, so that the door hinge is characterized by improved rigidity. In particular, in the event of long-term operation wear, deflection of pivot bearings and plain bearings as well as further signs of abrasion can be substantially delayed.

On their side lying opposite the link assembly the inserts can rest on a step of the connector body, and the step preferably extends over the entire width of the inserts.

On the opposing side of the inserts, that is to say toward the link assembly, it should be borne in mind that in a preferred embodiment of the link assembly a guide slot for one of the links is provided, so that then the free space available for the formation of an guide face is limited.

The guide face is preferably formed as a rib or web, which extends from one edge of the connector body only over a part of the width of the inserts. In principle such ribs or webs can also be provided on both sides of a guide slot.

During installation of the door hinge the inserts are arranged so that they are retained between the horizontal guide faces, and even later under load vertical forces can be withstood and in particular tilting of the inserts can be avoided. This applies in particular when according to a preferred embodiment of the invention the inserts are additionally connected, in particular screwed, to the common connector body. Releasable screws can also be used for example in order to adjust the inserts relative to the connector body in a first horizontal direction, and for this purpose for example the inserts can be arranged so as to be laterally movable on the connector body.

According to a preferred embodiment of the invention the connector body is inserted in positive engagement into a cavity of the housing that is U-shaped in cross-section perpendicular to the vertical direction. Such positive engagement can ensure that the connector body is laterally retained in the first housing, but can still be moved in the vertical direction. The first housing then forms a type of sliding guide for the connector body, which itself may be L-shaped or U-shaped. Level with the link assembly a type of double housing is then produced, consisting of the first housing and the connector body.

The connector body is provided in order to receive and to retain the inserts, and for this purpose the connector body itself is rigid and dimensionally stable. In particular, the connector body can be formed in one piece, for example as a metal casting. The first housing and the inserts are preferably formed as metal castings, for which in particular zinc pressure die-casting may be considered.

Since during adjustment of the link assembly relative to the first housing the inserts are received and retained in their position by the rigid connector body and the entire connector body is adjusted in the vertical direction relative to the first housing, vertical forces can be kept away from the link assembly itself in so far as the distance between the upper insert and the lower insert is constant and thus does not exert any constraints on the bearings of the link assembly.

According to a preferred embodiment of the invention there is between the link assembly and the inserts at least a slight play in the vertical direction. In this way for example, in addition to the weight to be transmitted by the link assembly, no further loads or constraints occur which can give rise to increased wear.

In order to be able to adjust the connector body relative to the first housing, various adjusting mechanisms such as adjusting cams or the like can be used.

According to a preferred embodiment of the invention, an adjusting mechanism has a wedge that can be actuated by a screw and acts on a wedge face of the connector body. The screw can for example pass through the adjustment wedge and can be received in a thread of the first housing. If the screw is then screwed into the adjustment wedge to different depths and the adjustment wedge acts on an associated wedge face of the connector body, this produces a particularly precise and easy adjustment in the vertical direction.

Advantageously the connector body can be locked on the first housing by retaining screws. In this way the weight can be uniformly carried and is not permanently applied to an adjusting mechanism.

As already described in the introduction, according to a preferred embodiment of the invention the link assembly has two links, of which one is rotatable on the inserts about a vertical axis of rotation and the other is movably and rotatably arranged in guide slots of the inserts. Such a link assembly is usually supported on the second housing in a similar manner.

The hinge construction according to the prior art described in the introduction is then produced, in which the kinematics of the door hinge can be varied by the form of the two co-operating links, the arrangement of the axes of rotation as well as the run of the guide slots. Alternatively, a link assembly in the manner of a scissor joint is possible, which for example has a plurality of links with a total of seven pivot pins. The alternative configurations of the link assembly are known for example from JP 6-288139.

BRIEF DESCRIPTION OF THE DRAWING

The invention is explained in greater detail below with reference to drawings showing only one embodiment. Therein.

SPECIFIC DESCRIPTION OF THE INVENTION

Figure 1:
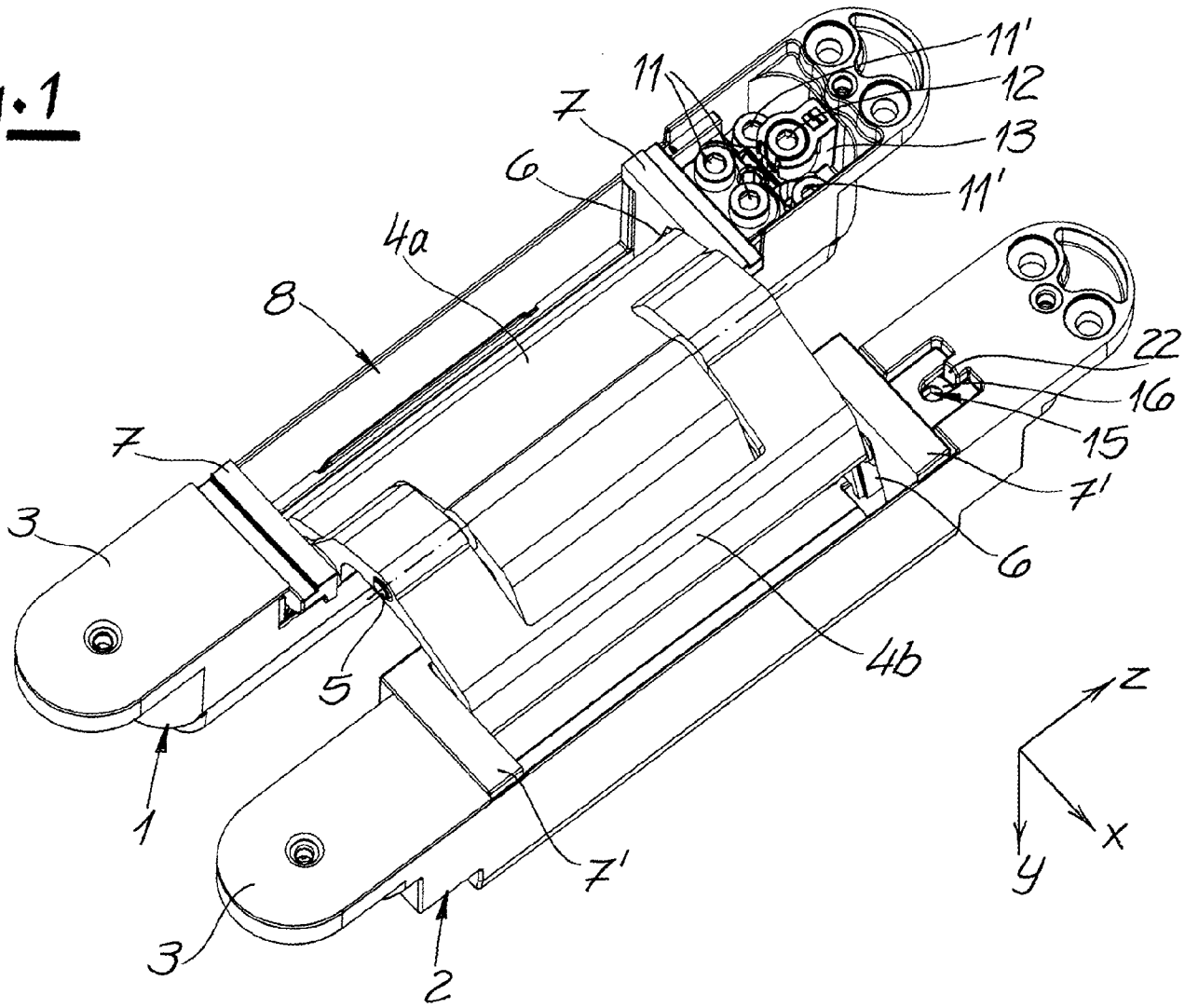
FIG. 1 is a view of a door hinge according to the invention.

As seen in FIG. 1 a recess-mount door hinge between an unillustrated door panel and frame in an open position has a cast-metal first housing 1 and a cast-metal second housing 2 pivotal through 180° relative to one another between the illustrated open position and a closed position about a vertical axis defined by a hinge pin 5. FIG. 1 further shows that the ends of the housings 1 and 2 are usually closed by covers 3, but in order to clarify the construction these covers 3 have not been shown in FIG. 1 at the upper ends of the housings 1 and 2.

The two housings 1 and 2 are connected to one another in a manner known per se by an assembly consisting of two links 4*a* and 4*b*. The two links 4*a* and 4*b* are pivotally connected to one another at the hinge pin 5 at the pivot axis extending in a vertical direction z. Furthermore, as known in the prior art (see U.S. patent application Ser. No. 14/341,810 filed 27 Jul. 2014) each of the links 4*a* and 4*b* is pivotal in both of the housings 1 and 2, with one end pivotal about an axis fixed in one of the housings 1 and 2 and the other end longitudinally movably in guide grooves 6 in the other of the housings 1 and 2. This way, as the two housings 1 move from the illustrated open position to an unillustrated folded position with their outer faces parallel and either very close or actually touching, the links 4*a* and 4*b* can be pushed back into the housings 1 and 2 as is well known in the art.

Figure 2:
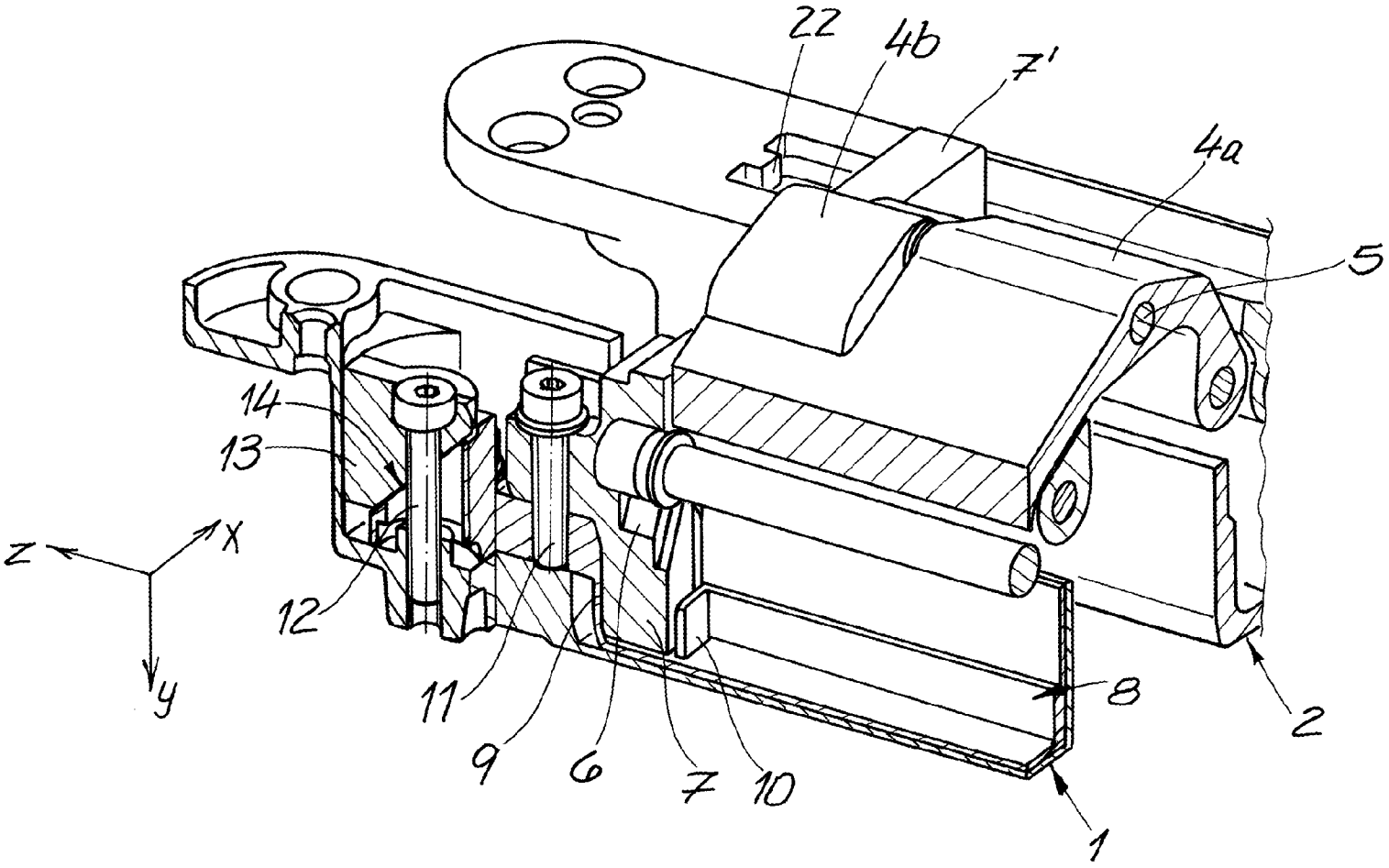
FIG. 2 is a longitudinal section through a first housing of the door hinge of FIG. 1.
Figure 3:
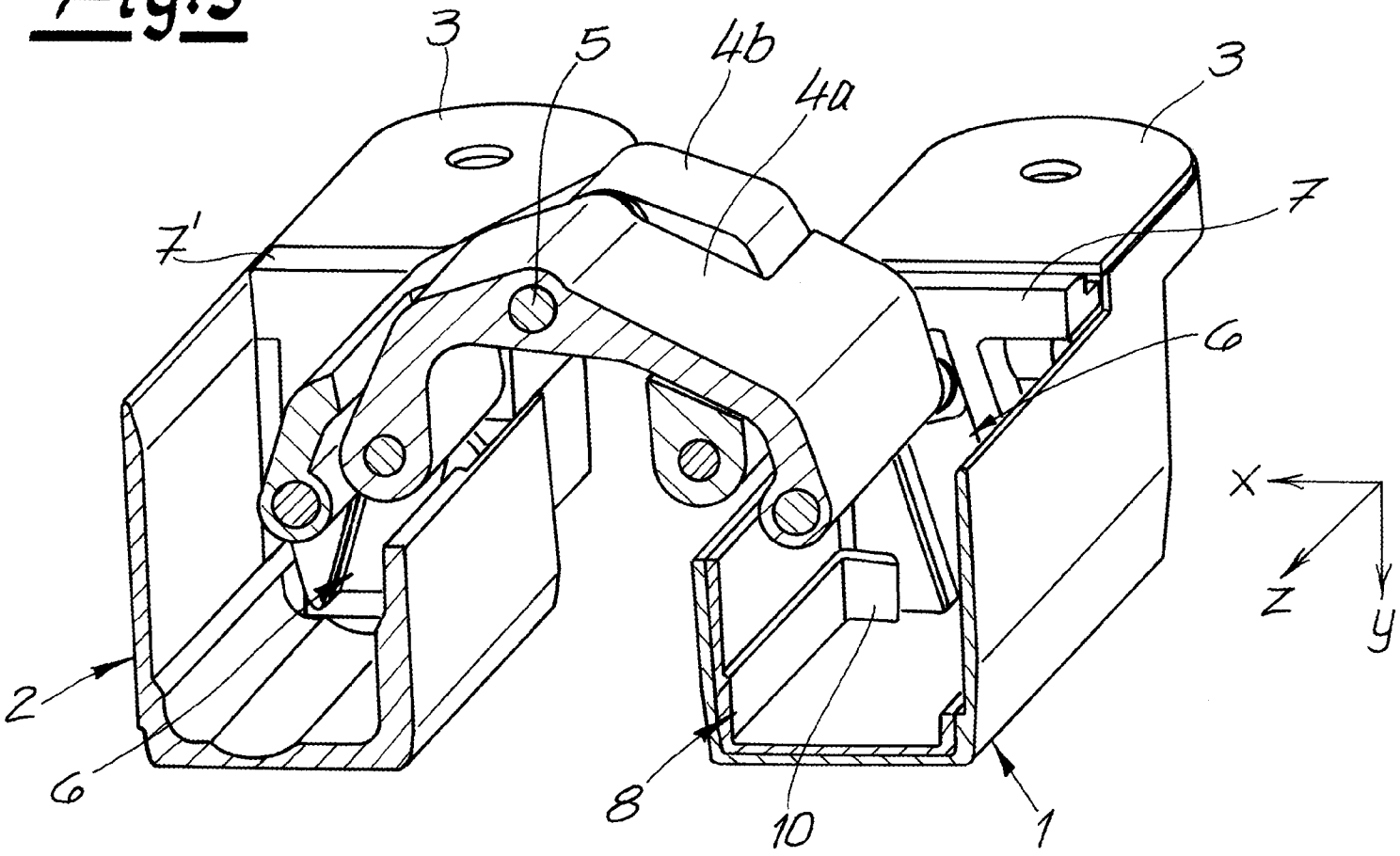
FIG. 3 is a cross section through the door hinge according to FIG. 1.

According to FIGS. 2 and 3 the two links 4*a* and 4*b* are retained in the first housing 1 on two separate but identical inserts 7 that are spaced apart from one another in the vertical direction z. The inserts 7 each form a respective one the two confronting holes for the ends of pin defining the fixed axis of one of the ends of one of the links 4*a* or 4*b* and the two grooves 6 in which the ends of the other slidable or movable pivot pin of end the other of the links 4*a* or 4*b* are seated. The inserts 7 are on an integral rigid connector body 8 extending vertically along the link assembly. FIGS. 2 and 3 show that the connector body 8 is fixed in a seat of the first housing 1 and is U-shaped in a horizontal section transverse to the vertical z, so that the connector body 8 is only limitedly movable in a vertical direction z with minimal lateral play relative to the first housing 1 in a horizontal direction x.

More particularly as shown in FIGS. 2 and 3, the body 8 is formed of cast metal and has massive ends forming slide surfaces 9 and in which screws 11 described below are seated and a thinner box-shaped central part in which is secured or which is formed with a U-shaped bar having right-angle ends forming surfaces 10 confronting the surfaces 9. This entire body 8 can move with the inserts 7 only limitedly vertically in the housing 1 under the action of the wedge assembly 14 as described below.

FIG. 2 further shows that the inserts 7 are each retained in positive engagement against movement on the connector body 8 in a vertical direction by the substantially horizontal surfaces 9 and 10 of the connector body 8.

The surface 9 against which each insert 7 rests on the side thereof opposite the link assembly may have a slightly angled position and/or bend, which within the context of the invention is still designated without restriction as horizontal since the surfaces 9 and 10 of the body 8 extend at most at only a small angle of a few degrees to the horizontal directions x and y. In particular, in a preferred embodiment of the housing 1 and 2 of the connector body 8 as well as the inserts 7 as metal castings, angles are for example necessary for demolding during manufacture. This produces the advantage that the substantially horizontal surface 9 and the side of the inserts 7 abutting this guide face can have a complementary shape precisely coordinated therewith.

It can be seen from FIG. 2 that—as explained above—the inserts 7 are retained and supported in a vertical direction z between the substantially horizontal surfaces 9 and 10, so that tilting of the inserts 7 is avoided and the result is particularly high stability. Furthermore, the inserts 7 are fastened to the connector body 8 by retaining screws 11. If the inserts 7 have longitudinal slots extending in the horizontal direction x for the retaining screws 11, adjustment of the door hinge in terms of a compression adjustment in the first horizontal direction x can also be achieved in a simple manner. The co-ordination of the first horizontal direction x and a second horizontal direction y relates to the orientation of the closed door panel in the door frame. The first horizontal direction x normally extends in the direction of the thickness of the door panel, whereas the second horizontal direction y extends parallel to the faces of the closed door panel.

Since at least with the retaining screws 11 tightened the inserts 7 are retained without play and precisely on the connector body 8, and the assembly formed by the connector body 8 together with the inserts 7 and the links 4*a* and 4*b* can be adjusted in the vertical direction z relative to the first main body 1, slight play can be provided in a vertical direction between the links 4*a* and 4*b* and the inserts 7, and this play is also maintained and makes movement of the links 4*a* and 4*b* on the inserts 7 possible without jamming.

According to FIG. 2 adjustment in the vertical direction z can be performed in a particularly simple manner by an adjusting mechanism that has a screw 12 seated in the housing 1 and bearing on an adjustment wedge 13. The screw 12 can shift the wedge 13 in the direction y along a horizontal end face of the first housing 1 and thereby act on an angled wedge face 14 of the connector body 8, so that the connector body 8 can be shifted in the vertical direction z along with the two inserts 7 and the link assembly 4*a*, 4*b*. FIG. 1 further shows that further retaining screws 11 are provided transversely flanking the adjustment screw 12 so as to fix the connector body 8 on the first housing 1. These screws 11' are threaded into the respective insert 7 and pass through slots extending in the direction x in the body 8 to allow for transverse adjustment of the hinge. When thus fixed by the screws 11 all of the forces acting on the connector body 8 do not act on the adjusting mechanism after the required door-panel height has been set during installation.

Thus within the context of the described embodiment, adjustment in the vertical direction z as well as in the first horizontal direction x is possible on the first housing 1, whereas adjustment in the second horizontal direction y is provided on the second housing 2. According to FIG. 4 two inserts 7' formed as metal castings like the inserts 7 that are spaced apart from one another and support the links 4*a* and 4*b* are also provided on the second housing 2. These inserts 7', which are braced between guide faces 9 and 10 in the second housing 2 like the inserts 7 in the first housing 1, are each movable by an adjusting screw 15 in the manner of an actuating spindle in the second horizontal direction y perpendicular to a front face of the second housing 2. In other words, the inserts 7' can be screwed to different depths into the second housing 2.

Figure 4:
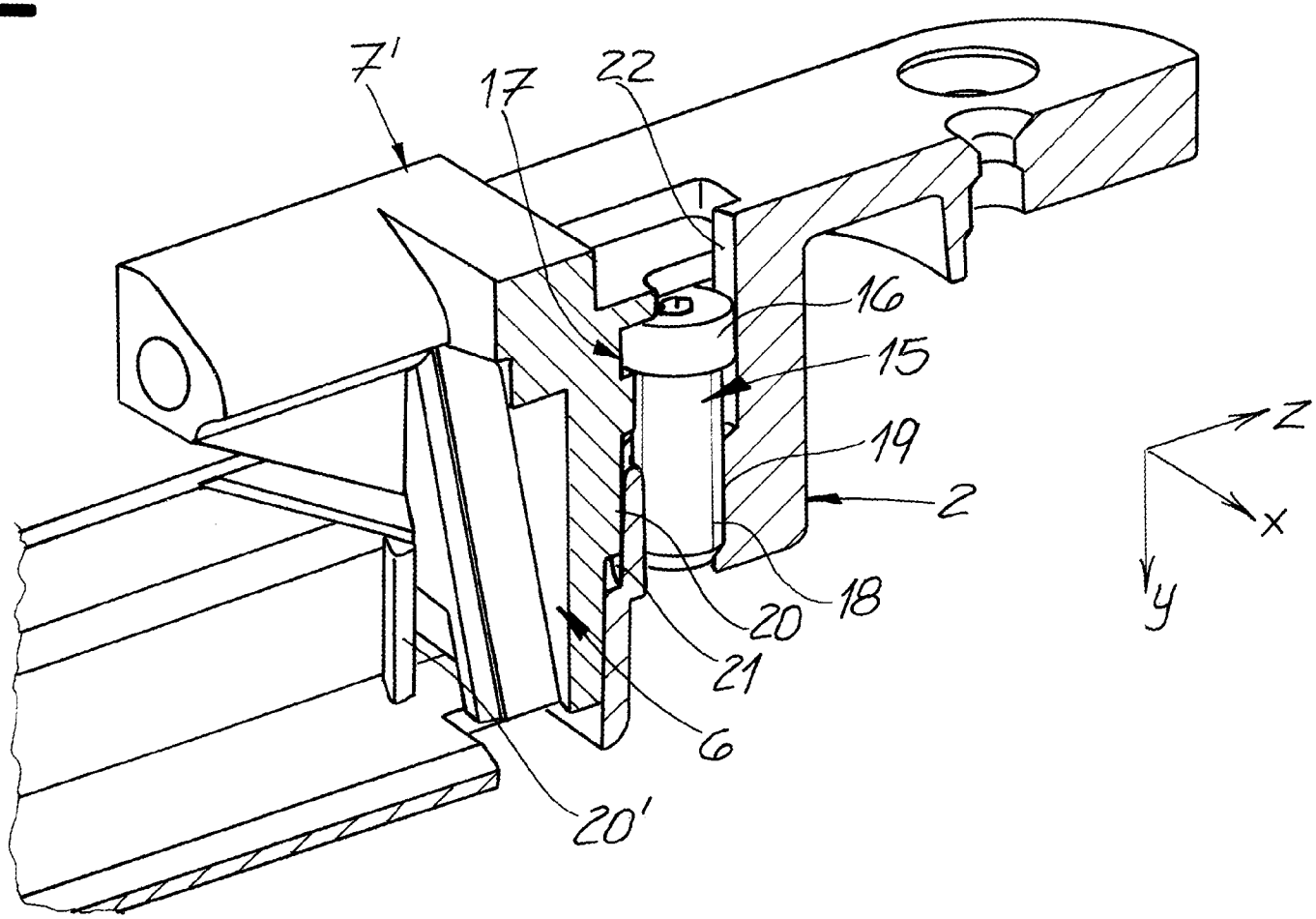
FIG. 4 is a detail of a longitudinal section through the second housing.

Here, the inserts 7' are guided in positive engagement in the second horizontal direction y by the faces 9 and 10 not shown in FIG. 4, and, as in the above-described embodiment, the adjusting screw 15 with a screw head 16 is inserted from an open side in the horizontal direction y into a seat 17 in the associated insert 7' and is retained in the seat 17 against movement in the second horizontal direction y relative to the insert 7'. In horizontal cross-section the seat 17 surrounds the screw head 16 approximately in a C shape, and the underside of the screw head 16 is retained by lateral arms of the seat 17. A threaded shank 18 of the adjusting screw 15 extends out of the end of the seat 17 and is received in a threaded bore 19 of the second housing 2.

In order to avoid play and a certain tilting of the inserts 7', different measures are provided within the context of the invention.

First of all, the inserts 7' are retained in positive engagement against movement in the vertical direction z between the two opposing and confronting faces 9 and 10 of the housing 2 (see FIG. 2) that are spaced apart in the direction z from one another, and the inserts 7' are also slidable on these surfaces 9 and 10 in the second horizontal direction y. According to FIG. 4 the inserts 7' have, on an outside face turned away from the link assembly, a guide structure in the form of a projecting rib 20 that extends in the second horizontal direction y and engages in a complementary guide groove 21 of the second housing 2 extending in the direction y. Due to these complementary guides formations 20 and 21 it is possible to prevent not only tilting forward and backward, but also lateral tilting.

The second housing 2 is approximately U-shaped in cross-section in its central region when viewed in the vertical direction z, and forms a seat cavity for the ends of the links 4*a* and 4*b* and also for the inserts 7'. A rib 20' also extending in the second horizontal direction y is provided as an opposing surface on at least one of the lateral sides of the U-shaped seat cavity of the housing 2.

Guiding of the inserts 7' largely without play or tilting can already be achieved by the described ribs 20 and 20' and the groove 21.

As an additional and/or alternative measure, play can also be reduced by limiting the movability of the adjusting screw 15 in the installed state. For this purpose, a web 22 of the second housing 2 extending in the second horizontal direction y is provided on an inner face of the seat 17, engages in the seat 17, and laterally delimits the screw head 16.

I claim:

1. A hinge for recessed installation between a door frame and a door panel, the hinge comprising:

first and second housings adapted for recessing in the door frame and an edge of the door panel;

a pair of links each having one end pivoted in one of the housings and another end slidable in the other of the housings, the links being pivoted together between the housings about a vertical axis extending in a vertical direction perpendicular to mutually perpendicular first and second horizontal directions;

two supports in the first housing having formations in which the one end of one of the links is pivotable, the links being received with limited vertical play between the supports;

a vertical connector body to which the supports are fixed, the connector body being limitedly vertically movable in the first housing along with the supports and links; and respective pairs of guide faces on the connector body spaced apart in the vertical direction and flanking each of the supports.

2. The hinge defined in claim 1, wherein the first housing is basically U-shaped and forms a cavity extending in the vertical direction and holding the connector body.

3. The hinge defined in claim 1, further comprising:

an adjustment mechanism including a wedge engaged between the first housing and the connector body for shifting the connector body with the supports and link assembly in the vertical direction in the first housing.

4. The hinge defined in claim 1, wherein the supports are movable in the first horizontal direction on the connector body.

5. The hinge defined in claim 4, further comprising:

retaining screws engaged between the supports and the connector body and tightenable to fix the supports on the connector body.

6. The hinge defined in claim 1, wherein the first housing, the connector body, and the supports are of cast metal.

7. The hinge defined in claim 1, further comprising:

retaining screws engaged between the connector body and the first housing and tightenable to fix the connector body on the first housing.

8. A hinge for recessed installation between a door frame and a door panel, the hinge comprising:

first and second housings adapted for recessing in the door frame and an edge of the door panel;

a pair of links each having one end pivotal about a vertical axis fixed in one of the housings and an opposite end pivotal about a vertical axis movable in at least one of the horizontal directions in the other of the housings, the links being pivoted together between the housings about a vertical axis extending in a vertical direction perpendicular to mutually perpendicular first and second horizontal directions;

two supports in the first housing having formations in which the one end of one of the links is pivotable;

a vertical connector body to which the supports are fixed, the connector body being limitedly vertically movable in the first housing along with the supports and links; and respective pairs of guide faces on the connector body spaced apart in the vertical direction and flanking each of the supports.

9. The hinge defined in claim 8, wherein the links are received with limited vertical play between supports.

* * * * *